United States Patent [19]

Horikiri et al.

[11] 4,070,446

[45] Jan. 24, 1978

[54] PROCESS FOR PRODUCTION OF CARBON FIBER

[75] Inventors: Shozo Horikiri, Amagasaki; Jiro Iseki, Toyonaka; Masao Minobe, Ibaraki, all of Japan

[73] Assignee: Sumitomo Chemical Company, Limited, Japan

[21] Appl. No.: 438,704

[22] Filed: Feb. 1, 1974

[30] Foreign Application Priority Data

| | | |
|---|---|---|
| Feb. 1, 1973 | Japan | 48-13440 |
| Feb. 13, 1973 | Japan | 48-18189 |
| May 18, 1973 | Japan | 48-56114 |

[51] Int. Cl.[2] ..... C01B 31/02

[52] U.S. Cl. ..... 423/447.2; 264/29.2; 264/DIG. 19; 526/22; 423/447.4

[58] Field of Search ..... 264/29.2; 8/140; 423/447.1, 447.2, 447.4, 447.5, 447.7; 526/22

[56] References Cited

U.S. PATENT DOCUMENTS

| | | | |
|---|---|---|---|
| 1,834,339 | 12/1931 | Dreyfus et al. | 8/140 |
| 1,834,388 | 12/1931 | Dreyfus et al. | 8/140 |
| 2,534,078 | 12/1950 | Strain | 526/22 |
| 3,405,204 | 10/1968 | McCormack | 264/83 |
| 3,542,746 | 11/1970 | Tackevdt et al. | 526/22 |
| 3,549,307 | 12/1970 | Hirsch | 8/115.5 |
| 3,607,672 | 9/1971 | Schmitt | 264/29 |
| 3,630,959 | 12/1971 | Kikka | 423/449 |
| 3,639,322 | 2/1972 | Barhgate et al. | 264/29 |
| 3,639,953 | 2/1972 | Kiruva et al. | 8/115.5 |
| 3,705,236 | 12/1972 | Ishikawa et al. | 423/447 |
| 3,720,759 | 3/1973 | Overhoff | 423/447 |
| 3,723,609 | 3/1973 | Mausmann et al. | 264/176 Z |
| 3,723,610 | 3/1970 | Fischer et al. | 264/29 |
| 3,736,309 | 5/1973 | Gump et al. | 264/29 |
| 3,784,679 | 1/1974 | Chiche | 423/447 |
| 3,887,747 | 6/1975 | Tamara et al. | 264/29 |
| 3,928,544 | 12/1974 | Yokota et al. | 264/29 |
| 3,940,377 | 2/1976 | Horowitz et al. | 526/22 |

FOREIGN PATENT DOCUMENTS

| | | | |
|---|---|---|---|
| 47-24184 | 7/1972 | Japan | 423/447 |
| 1,282,500 | 7/1972 | United Kingdom | 423/447 |

*Primary Examiner*—Jay H. Woo

*Attorney, Agent, or Firm*—Birch, Stewart, Kolasch and Birch

[57] ABSTRACT

A process for the production of carbon fiber, which comprises sulfonating polyethylene fiber with chlorosulfonic acid, sulfuric acid, fuming sulfuric acid or a mixture of two or more kinds thereof and carbonizing the resulting precursor fiber by heating at a temperature of 600° to 3,000° C, optionally while giving a tension to the fiber.

20 Claims, No Drawings

PROCESS FOR PRODUCTION OF CARBON FIBER

The present invention relates to a process for the production of carbon fiber from polyethylene.

Polyethylene has excellent characteristics which makes it useful as a starting material for producing carbon fiber, e.g., having an easily spinnable property and high carbon content, and it is also cheap. However, it has, hitherto, never been given attention as a starting material for carbon fiber, because it softens or melts at around the melting point thereof and loses its fiber form due to its peculiar thermoplasticity.

There has been known only a process for the production a carbon fiber from polyethylene by treating polyethylene fiber with radiation or a peroxide compound and thereby effecting crosslinking between the molecules thereof and then carbonizing the product (Japanese Patent Publication No. 16681/1964). However according to the studies made by the present inventors, it is very difficult to obtain the desired carbon fiber in high yield even by the known process, which is not suitable for the industrial production of carbon fiber.

Studies have been conducted to find a more practical process for producing carbon fiber from polyethylene, and it has been found that the desired carbon fiber can be easily produced from polyethylene in high carbonization yield such as 60 to 80% by sulfonating the polyethylene fiber with chlorosulfonic acid, sulfuric acid, fuming sulfuric acid or a mixture of two or more kinds thereof prior to its carbonization by heating.

In the present specification, the carbonization yield means the ratio by weight of the carbon fiber to the starting polyethylene fiber. Sulfuric acid means an aqueous sulfuric acid solution containing 90 or more % by weight, preferably 95 or more % by weight of sulfuric acid ($H_2SO_4$), and fuming sulfuric acid means a product obtained by the absorption of 3 or more % by weight of sulfuric anhydride into 97 or more % sulfuric acid.

The carbon fiber thus carbonized in such high carbonization yield has an extremely excellent mechanical strength. For instance, a carbon fiber having 10 $\mu$ in diameter obtained by carbonizing at 1,200° C has an average breaking strength of 25 t/cm$^2$.

It is well known that polyethylene can most easily give an orientated fiber among the synthetic polymers. The present inventors have found that when the orientated polyethylene fiber is used as the starting fiber, an orientated carbon fiber can be easily obtained by controlling the shrinkage of the fiber by means of giving an appropriate tension thereto in the sulfonation and/or carbonization steps, or by stretching the carbonization product.

The oriented carbon fiber has a specific structure wherein the crystal face (002) is parallel to the fiber axis and therefore has an extremely excellent elastic modulus, for instance 1,000 to 1,500 t/cm$^2$ in case of carbonization at 1,200° C, which varies according to its orientation degree. Furthermore, the carbon fiber has an extremely excellent graphitizability, which can be found by X-ray diffractometry. Accordingly, the elastic modulus can be extremely increased by raising the carbonization temperature.

When polyethylene fiber is sulfonated, the fiber (precursor fiber) thus obtained does not melt by heat and is merely made red-hot but does not burn even by putting it in a flame, and therefore it can be easily carbonized to carbon fiber by heating in a non-oxidizing atmosphere.

Thus, according to the present invention, the desired carbon fiber having excellent mechanical strength can be easily and economically produced from cheap polyethylene, which is one of the characteristics of the present invention.

There are two kinds of polyethylene, i.e. so-called low-density polyethylene and high-density polyethylene. The former has many branches in the molecule and has a low degree of crystallinity, and the latter has a few branches in the molecule and has a high degree of crystallinity. Both of these polyethylenes may be used in the present invention, but high-density polyethylene having a density of 0.94 or more g/cm$^3$ is preferable from the viewpoint of its easier spinnability and orientation degree of the fiber. A polyethylene fiber having a melt index of 0.01 to 20.0, more preferably 0.1 to 10.0, is very convenient for spinning.

As the starting material of the present invention, there may be used a polymer of ethylene monomer alone such as the above high-density polyethylene and low-density polyethylene, and also a copolymer, graft copolymer or blend thereof with another polymer such as ethylene-propylene copolymer or ethylene-styrene copolymer which contains 80 or more % by weight, preferably 90 or more % by weight of ethylene units. Moreover, the polyethylene may be blended with one or more kinds of other components, such as a plasticizer, stabilizer and lubricant.

The polyethylene fiber may be conveniently produced by melt-spinning but may be produced by other conventional methods. The product produced by melt spinning at a sufficiently high draft ratio may have a fiber structure, but may be further stretched in order to raise its orientation degree, to minimize its diameter and to raise its fiber strength.

The starting fiber thus obtained is sulfonated with chlorosulfonic acid, sulfuric acid, fuming sulfuric acid, or a mixture of two or more kinds thereof while giving a tension to the fiber or without tension.

The reaction temperature may be 20° to 150° C, preferably 60° to 90° C in case of using chlorosulfonic acid, and 80° to 200° C, preferably 100° to 180° C in case of using 98% sulfuric acid. In case of using fuming sulfuric acid, the suitable reaction temperature may vary according to the concentration of sulfuric anhydride contained therein, but may be usually 30° to 60° C when the concentration of sulfuric anhydride is 50% by weight and 40° to 70° C when the concentration of sulfuric anhydride is 25% by weight, and with a lowering of the concentration of sulfuric anhydride and suitable temperature come close to that in the case of using 98% sulfuric acid.

The sulfonation may be carried out at a lower temperature than that of the above range, but it requires a long time and is therefore uneconomical. On the other hand, at a higher temperature than that of the above range, the sulfonation reaction may be completed within a shorter time, but the reaction is carried out so violently that the final carbon fiber has inferior characteristics. When polyethylene fiber is sulfonated at a higher temperature than the softening point (about 130° C) of polyethylene, it should be previously treated at a lower temperature than the softening point and then the reaction temperature can be raised.

With the proceeding of the sulfonation, the polyethylene fiber changes its color from white to black. The reaction time may vary according to the reaction temperature, the kind of the sulfonating agent and the diameter of the fiber. In case of sulfonation of a fiber having 15μ in diameter by using chlorosulfonic acid, the suitable reaction time may be 60 to 120 minutes at 80° C and 30 to 60 minutes at 90° C, in case of using 98% sulfuric acid, it may be 4 to 6 hours at 120° to 130° C, and further in case of using fuming sulfuric acid containing sulfuric anhydride in a concentration of 50% or 25% by weight, it may be 30 to 60 minutes at 30° C or 2 to 3 hours at 60° C, respectively.

After the sulfonation, the fiber thus treated is washed well with a chlorinated organic solvent (e.g. chloroform, carbon tetrachloride, ethylene dichloride, ethylene trichloride, ethylene tetrachloride, or methylene dichloride), water, methanol, acetic anhydride, an aqueous alkali solution (e.g. an aqueous solution of an alkali metal or alkaline earth metal hydroxide, carbonate or bicarbonate, such as sodium hydroxide, potassium hydroxide, sodium carbonate, potassium carbonate, or sodium bicarbonate) until the wash liquid is no longer colored and is then dried. By these treatments, a black, flexible precursor fiber is obtained in a yield of 180 to 220% (on the basis of the weight of the starting polyethylene fiber) in case of using chlorosulfonic acid, 140 to 160% in case of using 98% sulfuric acid and 250 and 350% in case of using fuming sulfuric acid containing 25% sulfuric anhydride.

When the fiber is treated without tension in the sulfonation step and the subsequent washing and drying steps, it may significantly shrink and occasionally becomes 50 or less % of the original length and thereby the oriented structure in the original fiber entirely disappears. It is, therefore, necessary to give a tension to the fiber during the sulfonation, washing and drying steps for preventing the shrinkage of the fiber and for giving an orientated structure to the precursor fiber. The suitable tension may be in a range of 20 to 200 mg/d (d: denier), more preferably 50 to 150 mg/d. A tension of less than the above range may not be enough to prevent the shrinkage of the fiber, and on the other hand, a tension of more than the above range may undesirably induce breaking of the fiber.

When such tension is given to the fiber in the above steps, the length of the obtained precursor fiber becomes about 100 or more % of that of the original fiber in case of using polyethylene fiber containing spun filaments, and about 70 or more % of that of the original fiber in case of using polyethylene fiber comprising four times stretched filaments, and thereby the final carbon fiber can be given a suitable orientated structure.

The precursor fiber thus obtained is carbonized by heating to 600° C or more in an atmosphere of an inert gas (e.g. nitrogen, helium, or argon) or in a vacuum to give the desired carbon fiber.

The desired carbon fiber may be usually produced by carbonizing at a temperature of from 600° to 2,000° C. When the carbonization is carried out at a temperature of more than 2,000° C, usually from 2,000° to 3,000° C, it usually gives graphite fiber.

In the carbonization step, the precursor fiber may usually shrink about 30%. It is, therefore, preferable to give a tension to the fiber in the step for preventing the shrinkage thereof or to further stretch the resulting carbon fiber, by which the mechanical strength of the product is extremely improved.

According to X-ray diffractometry, there is observed some scattering, which is due to the non-crystalline carbons in the carbon fiber obtained by carbonizing at a temperature of 1,000° C or less, but with raising the carbonization temperature the intensity of the scattering lowers, and the carbon fiber obtained by carbonizing at a temperature of 2,000° C or more has no such scattering but has strong and sharp (002), (10) reflection, which means that the crystallinity of the product is extremely improved. Accordingly, the carbon fiber produced from polyethylene of the present invention may have excellent graphitizability.

The present invention is illustrated by the following Examples but is not limited thereto.

EXAMPLE 1

High-density polyethylene (Sumikathene Hard® 2703, MI=6.0, density =0.97 g/cm$^3$; made by Sumitomo Chemical Company, Limited) was melt-spun to give spun filaments having 11μ in diameter. The fiber thus obtained was immersed in chlorosulfonic acid at 80° C for 90 minutes without giving a tension to the fiber, allowed to stand for 15 minutes in air, washed well with demineralized water, and dried under a reduced pressure at 150° C for 1 hour to give black percursor fiber having a weight of 208% of that of the original polyethylene fiber. The fiber thus obtained was carbonized by raising the temperature from room temperature to 1,200° C at a rate of 1,200° C/hour in a nitrogen atmosphere without giving a tension to the fiber to give carbon fiber having 10μ in diameter. The carbonization yield was 75%. The length of the product was 57% of that of the original fiber. The strength and elastic modulus of the carbon fiber were 15.3 t/cm$^2$ and 720 t/cm$^2$, respectively. According to X-ray diffractometry, the carbon fiber had a comparatively low crystalline, nonorientated and turbostratic structure.

EXAMPLE 2

The same polyethylene fiber as used in Example 1 was treated with chlorosulfonic acid at 80° C for 90 minutes while giving a tension of 50 mg/d to the fiber. The length of the fiber thus trated was 18% longer than that of the original fiber. The fiber thus obtained was washed with chloroform and methanol respectively, and then dried in air to give precursor fiber (yield: 210%). The precursor fiber thus obtained was carbonized by raising the temperature from room temperature to 1,200° C at a rate of 400° C/hour in an argon atmosphere while giving a tension of 16 mg/d to the fiber to give carbon fiber having 8μ in diameter. The carbonization yield was 76%. The length of the product was 95% of that of the original fiber. The average strength and elastic modulus of the carbon fiber were 25.8 t/cm$^2$ and 1,420 t/cm$^2$, respectively. According to X-ray diffractometry, the carbon fiber clearly shows a crystalline structure orientated in the direction of the fiber axis.

EXAMPLE 3

The same polyethylene fiber as used in Example 1 was immersed in 98% sulfuric acid at 120° C for 1 hour and further at 160° C for 2 hours without giving a tension to the fiber. The fiber thus treated was washed well with water at room temperature and then dried at 150° C for 1 hour to give black precursor fiber having a weight of 169% of that of the original fiber. The fiber thus obtained was carbonized by raising the temperature from room temperature to 1,200° C at a rate of 1,200° C/hour in a nitrogen atmosphere without giving a tension to the fiber to give carbon fiber having 10μ in diameter. The carbonization yield was 68.8%. The length of the product was 53% of that of the original fiber. The average strength and elastic modulus of the carbon fiber were 14.2 t/cm$^2$ and 830 t/cm$^2$, respectively.

EXAMPLE 4

The same polyethylene fiber as used in Example 1 was immersed in 98% sulfuric acid while raising the temperature from 120° C to 180° C at a rate of 30° C/hour while giving a tension of 100 mg/d to the fiber. The length of the fiber thus treated was 16% longer than that of the original fiber. The fiber thus obtained was washed with water and air-dried to give precursor fiber (yield: 162%). The precursor fiber thus obtained was carbonized by raising the temperature from room temperature to 1,200° C at a rate of 600° C/hour in an argon atmosphere while giving a tension of 50 mg/d to the fiber to give carbon fiber having 7.5$\mu$ in diameter. The carbonization yield was 70.2%. The length of the product was 102% of that of the original fiber. The average strength and elastic modulus of the carbon fiber were 23.1 t/cm$^2$ and 1,500 t/cm$^2$, respectively. According to X-ray diffractometry, the carbon fiber showed a clearly crystalline structure orientated in the direction of the fiber axis.

EXAMPLE 5

The same polyethylene fiber as used in Example 1 was immersed in fuming sulfuric acid containing sulfuric anhydride in a concentration of 25% by weight at 60° C for 120 minutes without giving a tension to the fiber. The fiber thus treated was washed well with 35% diluted sulfuric acid and water in order, and then dried under a reduced pressure at 150° C for 1 hour to give precursor fiber having a weight of 293% of that of the original fiber. The precursor fiber thus obtained was carbonized by raising the temperature from room temperature to 1,200° C at a rate of 1,200° C/hour in a nitrogen atmosphere without giving a tension to the fiber to give carbon fiber having 11$\mu$ in diameter. The carbonization yield was 66.6%. The length of the product was 44% of that of the original fiber. The average strength and elastic modulus of the carbon fiber were 13.5 t/cm$^2$ and 780 t/cm$^2$, respectively.

What is claimed is:

1. A process for producing carbon fiber, which comprises sulfonating fiber consisting of polyethylene or a copolymer of ethylene containing 90 or more % by weight of ethylene units with a sulfonating agent selected from the group consisting of chlorosulfonic acid, sulfuric acid, fuming sulfuric acid and mixtures thereof and then carbonizing the resultant sulfonated product by heating at a temperature of from 600° to 2,000° C. in an atmosphere of an inert gas or in a vacuum.

2. The process according to claim 1, wherein the polyethylene fiber comprises polyethylene having a density of 0.94 or more g/cm$^3$ and a melt index of from 0.1 to 10.

3. A process for producing graphite fiber, which comprises sulfonating fiber consisting of polyethylene or a copolymer of ethylene containing 90 or more % by weight of ethylene units with a sulfonating agent selected from the group consisting of chlorosulfonic acid, sulfuric acid, fuming sulfuric acid and mixtures thereof and then carbonizing the resultant sulfonated product by heating at a temperature of from 2,000° to 3,000° C. in an atmosphere of an inert gas or in a vacuum.

4. The process according to claim 3, wherein the polyethylene fiber comprises polyethylene having a density of 0.94 or more g/cm$^3$ and a melt index of from 0.1 to 10.

5. The process according to claim 1, wherein the sulfonation is carried out by using chlorosulfonic acid at a temperature of from 60° to 90° C.

6. The process according to claim 3, wherein the sulfonation is carried out by using chlorosulfonic acid at a temperature of from 60° to 90° C.

7. The process according to claim 1, wherein the sulfonation is caried out by using chlorosulfonic acid which contains 30 or less % by volume of sulfuric acid.

8. The process according to claim 3, wherein the sulfonation is carried out by using chlorosulfuric acid which contains 30 or less % by volume of sulfuric acid.

9. The process according to claim 1, wherein the sulfonation is carried out by using sulfuric acid having a concentration of 90 or more % by weight.

10. The process according to claim 3, wherein the sulfonation is carried out by using sulfuric acid having a concentration of 90 or more % by weight.

11. The process according to claim 9, wherein the sulfonation is carried out at a temperature of from 100° to 180° C.

12. The process according to claim 10, wherein the sulfonation is carried out at a temperature of from 100° to 180° C.

13. The process according to claim 1, wherein the sulfonation is carried out by using fuming sulfuric acid containing sulfuric anhydride in a concentration of 50 or less % by weight.

14. The process according to claim 3, wherein the sulfonation is carried out by using fuming sulfuric acid containing sulfuric anhydride in a concentration of 50 or less % by weight.

15. The process according to claim 1, wherein said inert gas is nitrogen, helium or argon.

16. The process according to claim 3, wherein said inert gas is nitrogen, helium or argon.

17. The process according to claim 1, wherein the sulfonation and carbonization steps are carried out while the polyethylene fiber is under a tension of from 20 to 200 mg/d.

18. The process according to claim 3, wherein the sulfonation and carbonization steps are carried out while the polyethylene fiber is under a tension of from 20 to 200 mg/d.

19. A carbon fiber, which is produced by sulfonating fiber consisting of polyethylene with a member selected from the group consisting of chlorosulfonic acid, sulfuric acid and fuming sulfuric acid and then carbonizing the resultant sulfonated product by heating at a temperature of from 600° to 2,000° C. in an atmosphere of an inert gas or in a vacuum.

20. A graphite fiber, which is prooduced by sulfonating fiber consisting of polyethylene with a member selected from the group consisting of chlorosulfonic acid, sulfuric acid and fuming sulfuric acid and then carbonizing the resultant sulfonated product by heating at a temperature of from 2,000° to 3,000° C. in an atmosphere of an inert gas or in a vacuum.

* * * * *